US010047502B2

(12) United States Patent
O'Neill et al.

(10) Patent No.: US 10,047,502 B2
(45) Date of Patent: Aug. 14, 2018

(54) SYSTEM AND METHOD FOR CONTROLLING A WORK IMPLEMENT OF A MACHINE

(71) Applicant: Caterpillar Inc., Peoria, IL (US)

(72) Inventors: William N O'Neill, Eureka, IL (US); Michael Thomas Jackson, Hanna City, IL (US)

(73) Assignee: Caterpillar Inc., Deerfield, IL (US)

( * ) Notice: Subject to any disclaimer, the term of this patent is extended or adjusted under 35 U.S.C. 154(b) by 244 days.

(21) Appl. No.: 14/964,744

(22) Filed: Dec. 10, 2015

(65) Prior Publication Data

US 2017/0167113 A1 Jun. 15, 2017

(51) Int. Cl.

| | |
|---|---|
| ***E02F 9/22*** | (2006.01) |
| ***E02F 3/76*** | (2006.01) |
| ***E02F 3/84*** | (2006.01) |

(52) U.S. Cl.

CPC ..... *E02F 9/2217* (2013.01); *E02F 3/7618* (2013.01); *E02F 3/844* (2013.01); *E02F 9/2228* (2013.01); *E02F 9/2292* (2013.01)

(58) Field of Classification Search

CPC ..... E02F 9/2217; E02F 9/2228; E02F 9/2292; E02F 3/7618; E02F 3/844; E02F 3/433

See application file for complete search history.

(56) References Cited

U.S. PATENT DOCUMENTS

| | | | | |
|---|---|---|---|---|
| 3,179,120 | A * | 4/1965 | Erickson | E02F 3/433 137/101 |
| 3,297,183 | A * | 1/1967 | Klaviter | E02F 3/433 414/708 |
| 3,448,685 | A | 6/1969 | Kroth | |
| 3,568,707 | A | 3/1971 | Shore | |
| 3,792,792 | A * | 2/1974 | Bromberek | E02F 3/433 414/700 |
| 4,372,729 | A * | 2/1983 | Buschbom | E02F 3/433 414/700 |
| 4,505,339 | A | 3/1985 | Kramer et al. | |
| 4,622,886 | A | 11/1986 | Imada et al. | |
| 5,501,570 | A * | 3/1996 | Mozingo | E02F 3/432 414/700 |
| 6,129,158 | A | 10/2000 | Yamamoto et al. | |
| 6,945,335 | B2 | 9/2005 | Suzuki et al. | |
| 7,059,422 | B2 * | 6/2006 | Burgin | E02F 3/432 172/274 |
| 7,487,707 | B2 | 2/2009 | Pfaff et al. | |

(Continued)

*Primary Examiner* — Jamie L McGowan

(74) *Attorney, Agent, or Firm* — Miller, Matthias & Hull

(57) ABSTRACT

A control system for a work implement of a machine having a frame is provided. The control system includes a fluid source configured to provide a supply of pressurized fluid and a pair of tilt cylinders in fluid communication with the fluid source. The tilt cylinders are configured to operatively tilt the work implement with respect to the frame of the machine. Each of the tilt cylinders has a rod end and a cap end between which a regenerative valve is disposed to selectively allow fluid communication between the rod end and the cap end of a corresponding tilt cylinder. The control system further includes a controller communicably coupled to each of the regenerative valves. The controller is configured to vary an amount of restriction in each regenerative valve to regulate an amount of fluid flowing between the rod end and the cap end of the corresponding tilt cylinder.

20 Claims, 4 Drawing Sheets

(56) References Cited

U.S. PATENT DOCUMENTS

| | | | | |
|---|---|---|---|---|
| 7,913,491 | B2 | 3/2011 | Lin et al. | |
| 8,437,926 | B2 | 5/2013 | Shintani et al. | |
| 8,752,372 | B2 * | 6/2014 | Ramler | F15B 11/024 60/461 |
| 8,931,572 | B2 | 1/2015 | Nakata et al. | |
| 9,016,418 | B2 * | 4/2015 | Ootsuka | E02F 9/0833 180/324 |
| 2004/0231505 | A1 * | 11/2004 | Ioku | E02F 3/433 91/418 |
| 2004/0250677 | A1 * | 12/2004 | Ioku | E02F 3/433 91/471 |
| 2010/0122528 | A1 * | 5/2010 | Beschorner | F15B 11/024 60/424 |
| 2011/0283693 | A1 * | 11/2011 | Ramler | F15B 11/024 60/461 |
| 2012/0180470 | A1 * | 7/2012 | Schroeder | E02F 9/2217 60/414 |
| 2014/0102289 | A1 * | 4/2014 | Wu | E02F 9/2091 91/466 |
| 2015/0082782 | A1 | 3/2015 | Choi et al. | |

* cited by examiner

SYSTEM AND METHOD FOR CONTROLLING A WORK IMPLEMENT OF A MACHINE

TECHNICAL FIELD

The current disclosure relates to an implement of a machine, and more particularly to a system and a method for controlling a work implement of a machine.

BACKGROUND

Machines such as dozers are used to perform various operations such as, digging, dumping or leveling a surface of the ground. Such machines may typically employ an implement such as a blade to perform one or more of these operations. An operator may provide one or more inputs indicative of a desired position or movement of the implement. Accordingly, the implement may be tilted and/or rotated using one or more actuators, for example a pair of tilt cylinders based on the input/s from the operator.

However, during some operations, the implement may tilt excessively than required. In an example, the excess tilting may be due to uneven load distribution across a work area of the implement during dumping. Moreover, such tilting movement may create a perception to the operator indicating improper control of the implement. In such cases, the operator may not be able to set a desired position for the implement during the dump cycle. In some conventional control systems, undesirable tilting movement is controlled by regulating fluid communication between the tilt cylinders.

For reference, U.S. Pat. No. 3,196,755 relates to a flow control system for a load-handling apparatus having a plurality of piston and cylinder units. The pistons of the cylinder units are actuated away from one set of ends of the cylinders with load assistance and actuated away from the opposite set of ends of the cylinders against load resistance. The flow control system includes a means for connecting either set of ends of the cylinders with a source of fluid under pressure and for exhausting fluid from either set of ends of the cylinders in correlated in-one-end-out-the-other end manner. The means includes a single valve and a valve seat. The means further biases the valve into fluid sealing relation with the valve seat. The valve in the sealing relation blocks the exhaust from the other set of ends and becomes responsive to the pressure in the one set of ends to allow the exhaust of fluid from the other set of ends only after build-up of a predetermined pressure in the one set of ends to prevent cavitation in the one set of ends.

SUMMARY OF THE DISCLOSURE

In one aspect of the current disclosure, a control system for a work implement of a machine having a frame is provided. The control system includes a fluid source configured to provide a supply of pressurized fluid, and a pair of tilt cylinders in fluid communication with the fluid source. The tilt cylinders are pivotally coupled to the work implement and are configured to operatively tilt the work implement with respect to the frame of the machine. Each of the tilt cylinders has a rod end and a cap end. The control system further includes a regenerative valve disposed between the rod end and the cap end of each tilt cylinder. Each of the regenerative valves is configured to selectively allow fluid communication between the rod end and the cap end of the corresponding tilt cylinder. The control system further includes a controller communicably coupled to the pair of regenerative valves. In response to a dump cycle of the work implement, the controller is configured to vary an amount of restriction in each regenerative valve to regulate an amount of fluid flowing between the rod end and the cap end of the corresponding tilt cylinder.

In another aspect of the current disclosure, a method of controlling a work implement of a machine is provided. The machine has a pair of tilt cylinders operatively coupled to the work implement and configured to move the work implement with respect to a frame of the machine. The method includes providing pressurized fluid to each cap end of the tilt cylinders. The method further includes determining an operational parameter of at least one of the tilt and lift cylinders. The method further include selectively moving each of the regenerative valves independently during a dump cycle of the work implement to at least partially restrict a flow of fluid from the rod end to the cap end based on the determined operational parameter.

In yet another aspect of the current disclosure, a machine is provided. The machine includes a frame. The machine also includes a work implement movably coupled to the frame. The machine further includes a fluid source disposed on the frame and configured to provide a supply of pressurized fluid. The machine also includes a pair of tilt cylinders in fluid communication with the fluid source. The tilt cylinders are also coupled to the frame and operatively coupled to the work implement. The tilt cylinders are configured to operatively tilt the work implement with respect to the frame of the machine. Each of the tilt cylinders has a rod end and a cap end. The control system further includes a regenerative valve disposed between the rod end and the cap end of each tilt cylinder. Each of the regenerative valves is configured to selectively allow fluid communication between the rod end and the cap end of the corresponding tilt cylinder. The control system further includes a controller communicably coupled to the pair of regenerative valves. In response to a dump cycle of the work implement, the controller is configured to vary an amount of restriction in each regenerative valve to regulate an amount of fluid flowing between the rod end and the cap end of the corresponding tilt cylinder.

Other features and aspects of this disclosure will be apparent from the following description and the accompanying drawings.

DETAILED DESCRIPTION

Reference will now be made in detail to specific aspects or features, examples of which are illustrated in the accompanying drawings. Wherever possible, corresponding or similar reference numbers will be used throughout the drawings to refer to the same or corresponding parts.

Figure 1:
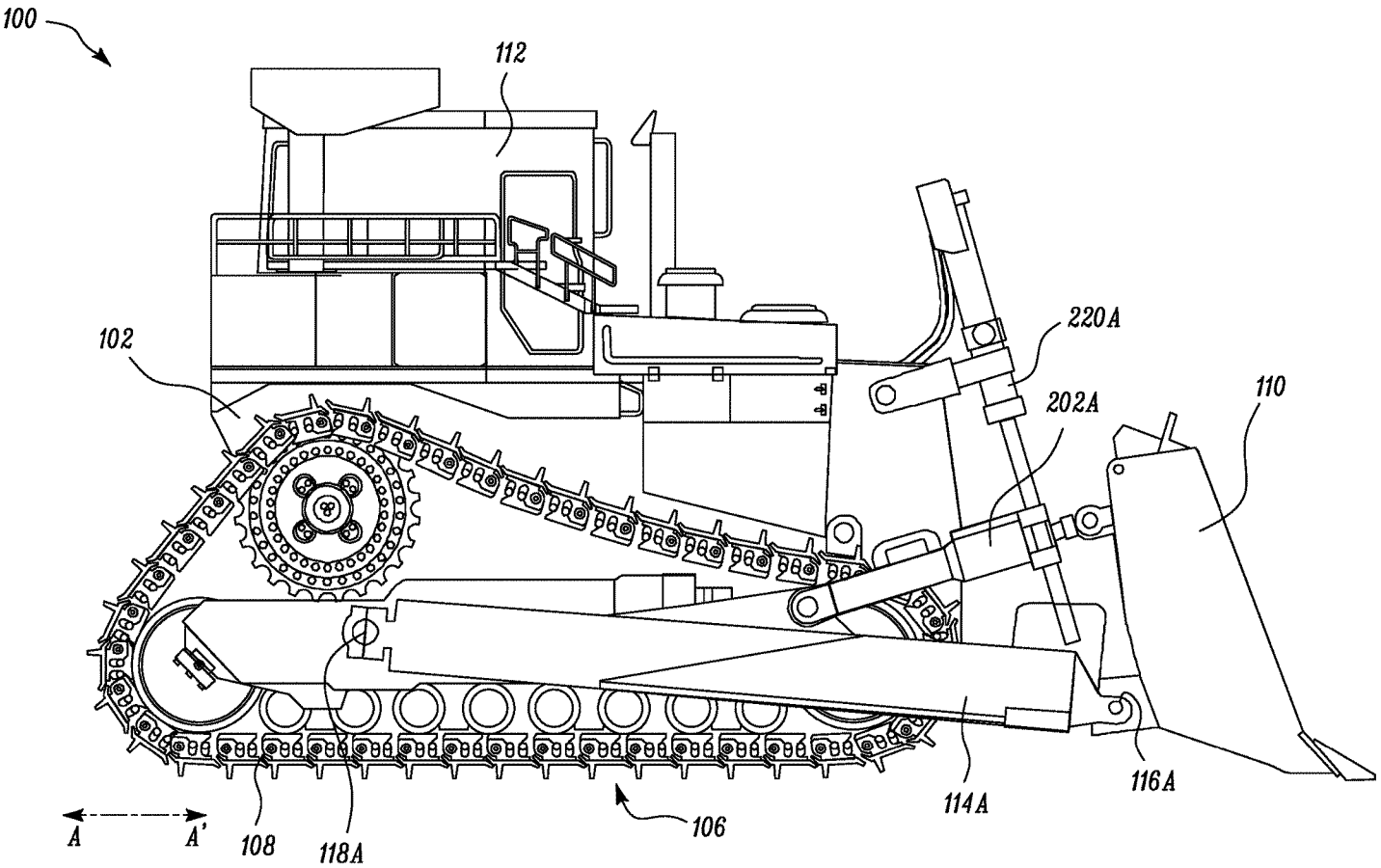
FIG. 1 is a side view of a machine showing a work implement, according to an exemplary embodiment of the current disclosure.

FIG. 1 illustrates a side view of a machine 100, according to an exemplary embodiment of the current disclosure. In the illustrated embodiment, the machine 100 is a dozer. The machine 100 may be a fixed or a mobile machine that is configured to perform some type of operation associated with an industry such as mining, construction, farming, transportation, or any other industry known in the art. For example, the machine 100 may be an excavator, a harvester, a backhoe or other machines known in the art.

The machine 100 includes a frame 102 defining a longitudinal axis AA' and a transverse axis BB' (shown in FIG. 2) that is substantially perpendicular to the longitudinal axis AA'. The machine 100 also includes a set of ground engaging members 108 supported on the frame 102. In the illustrated embodiment, the machine 100 includes an undercarriage 106 supported on the frame 102 of the machine 100. The undercarriage 106 includes the set of ground engaging members 108 embodied as a track assembly in FIG. 1. The track assembly may be configured to rotate thereby propelling the machine 100. Alternatively, the set of ground engaging members 108 may be a plurality of wheels configured to propel the machine 100.

The machine 100 further includes a work implement 110 configured to perform various tasks at a worksite. The work implement 110 may be configured to engage, penetrate, or cut the surface of the worksite and/or may be further configured to move the earth to accomplish a predetermined task. The worksite may include, for example, a mine site, a landfill, a quarry, a construction site, or any other type of worksite. Moving the earth may be associated with altering the geography at the worksite and may include, for example, a grading operation, a scraping operation, a leveling operation, a bulk material removal operation, or any other type of geography altering operation at the worksite.

In the illustrated embodiment, the work implement 110 is a blade that is movably mounted to the frame 102. The work implement 110 may be disposed on the frame 102 at a front end of the machine 100. The work implement 110 may be configured to perform digging operation to dig material from the work site and also hold the material therein. In addition to holding the material, the work implement 110 may also be moved along the longitudinal axis AA' to reach a location for dumping the material. Additionally, during the dump cycle, the work implement 110 may also be raised to reach the location for dumping the material. Further, the work implement 110 may also be configured to rotate about the transverse axis BB' upon reaching the location for performing a dumping operation on the material.

In one embodiment, a dump cycle for the work implement 110 may be defined as a cycle in which the work implement 110 performs the dumping operation. As such, the work implement 110 may be configured to rotate about the transverse axis BB' during the dump cycle. In another embodiment, the dump cycle for the work implement 110 may be defined as a cycle in which the work implement 110 performs the holding and dumping operation. Accordingly, during the dump cycle, the work implement 110 may move to reach the dumping location and also rotate about the transverse axis BB' of the frame 102. In one example, during the dump cycle, the work implement 110 may be moved along the longitudinal axis AA' and/or raised to reach the dumping location and subsequently rotated about the transverse axis BB'. In another example, during the dump cycle, the work implement 110 may be raised and simultaneously rotated about the transverse axis BB' to perform the dumping operation.

In various other embodiments, the work implement 110 may include any device used in the performance of a task. For example, the work implement 110 may include a blade, a bucket, a shovel, a hammer, an auger, a ripper, or any other task-performing device known in the art. Further, the work implement 110 may be configured to pivot, rotate, slide, swing, or move relative to the frame 102 of the machine 100 in any other manner known in the art.

The machine 100 may further include an operator station or cab 112 containing controls or input devices for operating the machine 100. The cab 112 may also include one or more input devices (not shown) for propelling the machine 100, controlling the work implement 110 and/or other machine components. In an example, the one or more input devices may include one or more joysticks, levers, switches and pedals disposed within the cab 112 and may be adapted to receive input from an operator indicative of a desired movement of the work implement 110 and the set of ground engaging members 108. In the illustrated embodiment, the cab 112 may include an input device (not shown) such as, a joystick, or a control button operable to generate commands for the work implement 110 to implement one or more operations of the dump cycle.

The machine 100 may further include a power source (not shown) to supply power to various components including, but not limited to, the set of ground engaging members 108, and the work implement 110. In an example, the power source may be an engine. The engine may embody, for example, a diesel engine, a gasoline engine, a gaseous fuel-powered engine, or any other type of combustion engine known in the art. It is contemplated that the power source may alternatively embody a non-combustion source of power (not shown) such as, for example, a fuel cell, a power storage device, or another suitable source of power.

Figure 2:
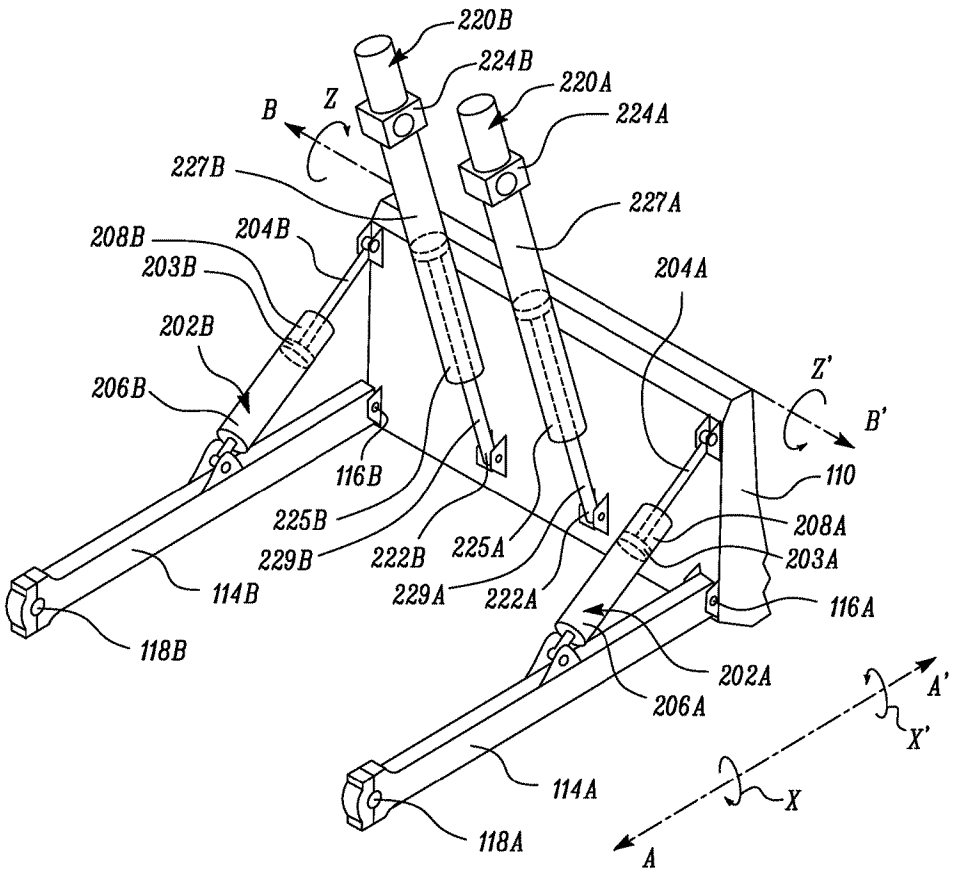
FIG. 2 is a partial perspective view of the machine showing a control system for the work implement, according to an embodiment of the current disclosure.

Referring to FIGS. 1 and 2, the machine 100 may include a pair of push arms 114A, 114B (also collectively referred to as "the push arms 114") spaced apart from each other. First ends 116A, 116B of the push arms 114A, 114B respectively, may be pivotally coupled to the work implement 110. As shown in FIG. 1, second ends 118A, 118B of the push arms 114A, 114B may be pivotally coupled to the undercarriage 106. Alternatively, the second ends 118A, 118B may be coupled to the frame 102. In an example, the push arms 114 may be connected to the work implement 110 and the frame 102 in a conventional manner; such as by a pivot shaft that pivotally connects the work implement 110 to the frame 102. The push arms 114 may have substantially the same length and are configured to hold the work implement 110 at the front end of the machine 100. Further, the push arms 114 may be configured to move the work implement 110 along the longitudinal axis AA'.

Figure 3:
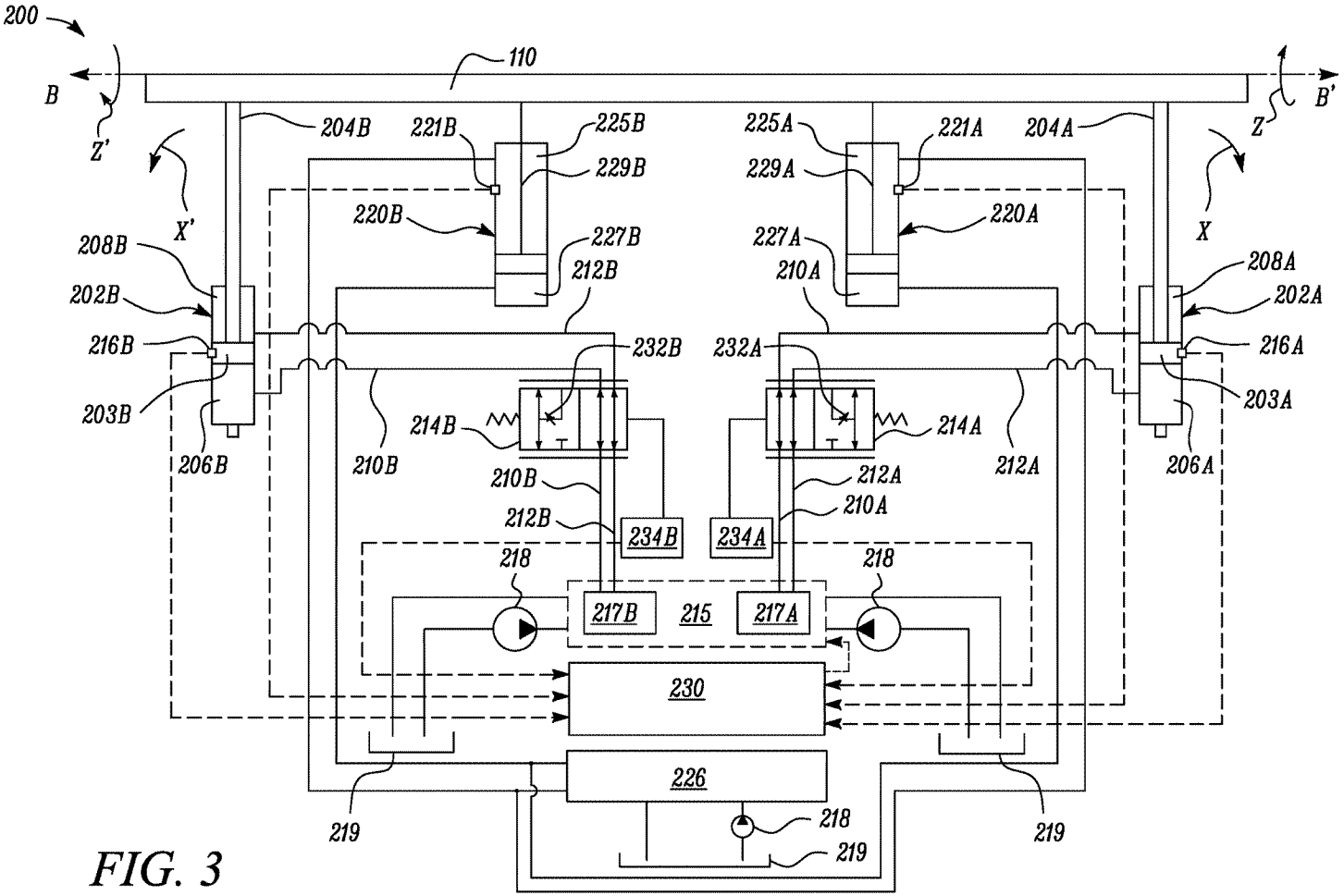
FIG. 3 is a circuit diagram of the control system, according to an embodiment of the current disclosure.

Referring to FIGS. 2 and 3, the machine 100 further includes a control system 200 for the work implement 110. The control system 200 includes a pair of tilt cylinders 202A, 202B (also collectively referred to as "the tilt cylinders 202") coupled to the frame 102 of the machine 100. The tilt cylinders 202A, 202B may include rods 204A, 204B respectively, that are slidably received therein. The rods 204A, 204B can be moved back and forth in the corresponding tilt cylinders 202A, 202B, in a manner as known to persons skilled in the art, for rotating the work implement 110 about the longitudinal axis AA' and the transverse axis BB' of the machine 100. The rod 204A may include a piston 203A that is operable to divide the inside of the tilt cylinder 202A in two chambers, namely, the cap end 206A and the rod end 208A. Similarly, the rod 204B may include a piston 203B that is operable to divide the inside of the tilt cylinder 202B in two chambers, namely, the cap end 206B and the rod end 208B. In the illustrated embodiment, a length of the tilt cylinders 202A, 202B may be changed via an extending or retracting movement of the rods 204A, 204B inside the corresponding tilt cylinders 202A, 202B. This extending or retracting movement of the rods 204A & 204B results from changing the relative volumes of hydraulic fluid in the rod ends 208A, 208B and the cap ends 206A, 206B.

Each of the tilt cylinders 202 are coupled to the frame 102 proximal to the cap ends 206A, 206B. In an example as shown in FIG. 3, cap ends 206A, 206B of the tilt cylinders 202 may be coupled proximal to the frame 102 vis-à-vis corresponding push arms 114A, 114B using fasteners such as, but not limited to, brackets or pivoting links. Each of the tilt cylinders 202 is also pivotally coupled to the work implement 110. In an example as shown in FIG. 3, the tilt cylinders 202 may be coupled to the work implement 110 adjacent to the rod ends 208A, 208B.

However, in an alternative embodiment, rod ends 208A, 208B of the tilt cylinders 202A, 202B may be coupled proximal to the frame 102 or to the corresponding push arms 114A, 114B while the cap ends 206A, 206B of the respective tilt cylinders 202A, 202B are coupled proximal to the work implement 110.

The control system 200 may also include a tilt valve unit 215 disposed in fluid communication with each of the tilt cylinders 202A and 202B respectively. In the illustrated embodiment, the tilt valve unit 215 includes a first valve assembly 217A and a second valve assembly 217B. The first valve assembly 217A may be configured to selectively regulate a supply of hydraulic fluid to and from the tilt cylinder 202A. The second valve assembly 217B may be configured to selectively regulate a supply of hydraulic fluid to and from the tilt cylinder 202B.

As shown in FIG. 3, each of the first and second valve assemblies 217A, 217B may be in fluid communication with a fluid source 218 and a fluid tank 219. The fluid source 218 is configured to selectively communicate fluid with the cap ends 206A, 206B and the rod ends 208A, 208B of the corresponding tilt cylinders 202A, 202B.

In an example, the first valve assembly 217A may include two valves (not shown). One of these valves may be fluidly communicated between the fluid source 218 and the cap end 206A to selectively supply a pressurized fluid to the cap end 206A. Further, the other valve may be fluidly communicated between the cap end 206A and the fluid tank 219 to selectively drain the fluid from the cap end 206A to the fluid tank 219. Similarly, the valves may also be fluidly communicated between the fluid source 218 and the rod end 208A; and between the fluid tank 219 and the rod end 208A. The valves may embody any suitable configuration such as, but not limited to, electrohydraulic valves known in the art.

As such, when the fluid source 218 is fluidly connected to the cap end 206A, generally, the fluid tank 219 can be fluidly connected to the rod end 208A. Conversely, when the fluid source 218 is fluidly connected to the rod end 208A, generally, the fluid tank 219 can be fluidly connected to the cap end 206A. Similar to the first valve assembly 217A, the second valve assembly 217B may also include a pair of valves fluidly communicated with the fluid source 218 and the fluid tank 219. Accordingly, the valves from the second valve assembly 217B may be configured to selectively communicate fluid between the cap end 206B, the rod end 208B, the fluid source 218 and the fluid tank 219 as described above with reference to the first valve assembly 217A.

However, any type, configuration, or arrangement of valves may be implemented in the first and second valve assemblies 217A, 217B to suit a specific requirement of an application. Such implementation is merely exemplary in nature and hence, should not be construed as limiting of this disclosure.

The tilt cylinders 202 are configured to rotate the work implement 110 about the longitudinal axis AA' and the transverse axis BB' of the frame 102 of the machine 100. A retracting or extending movement of any one of the tilt cylinders 202A, 202B may rotate the work implement 110 about the longitudinal axis AA' of the frame 102 of the machine 100. In an example, pressurized hydraulic fluid may flow into the cap end 206A of the tilt cylinder 202A, thereby extending the rod 204A out of the tilt cylinder 202A and rotating the work implement 110 in a counter-clockwise direction X' about longitudinal axis AA' (See direction arrow X' in FIG. 2). As the pressurized fluid flows from the fluid source 218 into the cap end 206A of the tilt cylinder 202A, fluid flows out of the rod end 208A of the tilt cylinder 202A to the fluid tank 219. In another example, when pressurized fluid flows into the rod end 208A of the tilt cylinder 202A, the rod 204A is retracted into the tilt cylinder 202A, thereby rotating the work implement 110 in a clockwise direction X about longitudinal axis AA' (See direction arrow X in FIG. 2). As the pressurized fluid flows into the rod end 208A, fluid present at the cap end 206A of the tilt cylinder 202A flows out of the cap end 206A to the fluid tank 219. It may be noted that the tilt cylinder 202B is also configured to operate in a manner similar to that of the tilt cylinder 202A, as described above, to rotate the work implement 110 about the longitudinal axis AA' of the frame 102 of the machine 100.

However, in another example, if the pressurized hydraulic fluid flows simultaneously into cap ends 206A, 206B of both the tilt cylinders 202A, 202B, then the rods 204A, 204B from both the tilt cylinders 202A, 202B extend forward and cause the work implement 110 to be rotated in a clockwise direction Z about transverse axis BB' (See direction arrow Z' in FIG. 2). At this point, as the pressurized fluid flows into the cap ends 206A, 206B from the fluid source 218, fluid from the rod ends 208A, 208B of the corresponding tilt cylinders 202A, 202B flows back to the fluid tank 219. In yet another example, if the pressurized hydraulic fluid flows simultaneously into rod ends 208A, 208B of both the tilt cylinders 202A, 202B, then the rods 204A, 204B from both the tilt cylinders 202A, 202B retract into the tilt cylinders 202A, 202B thereby causing the work implement 110 to be rotated in a counter-clockwise direction Z' about transverse axis BB' (See direction arrow Z' in FIG. 2).

In another embodiment of this disclosure, the tilt cylinders 202 may be coupled to other suitable linkage systems (not shown) such that retracting the rod 204A inside the tilt cylinder 202A by supplying the pressurized hydraulic fluid into the rod end 208A may rotate the work implement 110 in a counter-clockwise direction X' about longitudinal axis AA'. As the pressurized fluid flows into the rod end 208A from the fluid source 218, fluid present at the cap end 206A of the tilt cylinder 202A flows out of the cap end 206A to the fluid tank 219. Similarly, with pairing of suitable linkage systems to the tilt cylinders 202A, 202B and the work implement 110, when pressurized fluid flows into the cap end 206A, the rod 204A extends from the tilt cylinder 202A and such extension can be transformed by the linkage systems into rotating the work implement 110 in a clockwise direction X about longitudinal axis AA'. As the pressurized fluid flows into the cap end 206A, fluid present at the rod end 208A flows out of the tilt cylinder 202A to the fluid tank 219.

It may be noted that with use of the linkage systems disclosed herein, the tilt cylinder 202B may operate in a manner similar to that of the tilt cylinder 202A, as described above, to rotate the work implement 110 about the longitudinal axis AA' of the frame 102 of the machine 100.

However, it may be contemplated to implement any other linkage systems to couple the tilt cylinders 202 to the frame 102 and/or the work implement 110 based on a type of application.

The fluid source 218 may include any source of pressurized hydraulic fluid that would be known by an ordinary person skilled in the art. In an example, the fluid source 218 may include a fixed displacement pump (not shown), a variable displacement pump or others. The fluid tank 219 may include any reservoir for holding fluid that would be known by any person of ordinary skill in the art.

The tilt valve unit 215 as illustrated in FIG. 3, is exemplary in nature and non-limiting to this disclosure, and it may be envisioned to use other configurations for the tilt valve unit 215 to implement the features of the present disclosure.

As shown, the control system 200 further includes multiple fluid lines 210A, 210B & 212A, 212B that are configured to allow independent fluid communication of the cap ends 206A, 206B and the rod ends 208A, 208B of the respective tilt cylinders 202A, 202B with the corresponding valve assemblies 217A, 217B of the tilt valve unit 215. Further, the control system 200 also includes a pair of regenerative valves 214A, 214B (also collectively referred to as "the regenerative valves 214") disposed in each pair of fluid lines 210A, 212A & 210B, 212B respectively. The regenerative valve 214A may be disposed in the first pair of fluid lines 210A, 212A while the regenerative valve 214B may be disposed in the second pair of fluid lines 210B, 212B. In the illustrated embodiment, each of the regenerative valves 214 is a spring-loaded, two position, electrically actuated spool valve. In an example, one or both regenerative valves 214A, 214B may be spring biased to a closed position. In another example, one or both regenerative valves 214A, 214B may be spring biased to an open position. In another embodiment, the regenerative valve 214 may be a proportional valve. In such a case, the regenerative valve 214 may be partially opened and partially closed. In various other embodiments, the regenerative valve 214 may embody any valve known in the art that is configured to be electrically controlled to regulate a flow of the hydraulic fluid therethrough. Accordingly, the regenerative valves 214 may be configured to be operable in the open position and the closed position. When the regenerative valves 214A, 214B are in open position, cap ends 206A, 206B and rod ends 208A, 208B of respective tilt cylinders 202A, 202B are disposed in independent fluid communication with corresponding valve assemblies 217A, 217B from the tilt valve unit 215.

In the closed position of the regenerative valve 214A, fluid communication between the cap end 206A of the tilt cylinder 202A and the valve assembly 217A continues to remain open. However, with implementation of the closed position in the regenerative valve 214A, fluid communication from the rod end 208A of the tilt cylinder 202A also becomes linked with the fluid communication between the cap end 206A of the tilt cylinder 202A and the valve assembly 217A i.e., flow in the fluid line 212A becomes linked with flow in the fluid line 210A. As shown, the closed position of the regenerative valve 214A also includes a variable restriction 232A so as to variably restrict or permit a flow of fluid i.e., by way of increasing or decreasing its flow-rate as the fluid flows from fluid line 212A into fluid line 210A. It may be noted that such similar variable restriction, denoted by alpha-numeral '232B', is present in the closed position of regenerative valve 214B. Such similar variable restriction 232B should hereby be understood as being operable in a manner similar to that of the variable restriction 232A of regenerative valve 214A.

Each of these variable restrictions 232A, 232B can help in producing a resistance to the movement of the rod 204A, 204B within the corresponding tilt cylinder 202A, 202B. In accordance with the illustrated example of FIG. 3, when in the closed position, the variable restriction 232A from the regenerative valve 214A can be varied in magnitude i.e., increased or decreased so as to change the flow-rate of fluid flowing from fluid line 212A to fluid line 210A. This way, fluid flowing from fluid line 212A into fluid line 210A can beneficially oppose an incoming flow of fluid from the valve assembly 217A via the fluid line 210A thereby offering a resistance to the movement of the rod 204A. The resistance offered by the fluid entering from the fluid line 212A into fluid line 210A can therefore prevent a rapid extension of the rod 204A out of the tilt cylinder 202A. Similarly, when in the closed position, the variable restriction 232B from the regenerative valve 214B can be operated to offer resistance to movement of the rod 204B in a manner as described above with reference to the variable restriction 232A.

Aspects of the present disclosure seek to employ the pair of variable restrictions 232A and 232B in the regenerative valves 214A and 214B for controlling a movement of any one tilt cylinder 202A, 202B relative to another of the tilt cylinders 202A, 202B. In one aspect, one or both of the variable restrictions 232A and 232B disclosed herein may be operated to prevent one of the tilt cylinders 202A, 202B from over-running or running past another of the tilt cylinders 202A, 202B for e.g., when a load on the work implement 110 is unbalanced across a load-bearing surface of the work implement 110. Moreover, one or both of the variable restrictions 232A and 232B disclosed herein may be operated to at least reduce a difference between the displacements of the tilt cylinders 202A and 202B during the dump cycle.

In another aspect, one or both of the variable restrictions 232A and 232B may be operated to cause different rates of displacements in each of the tilt cylinders 202A and 202B disclosed herein. Moreover, one or both of the variable restrictions 232A and 232B can be further operated to maintain the difference between the displacements of the tilt cylinder 202A and the tilt cylinder 202B during the dump cycle.

In yet another aspect, one or both of the variable restrictions 232A and 232B may be operated to reduce the difference to a predetermined value and further maintain the difference at the predetermined value. In yet another aspect, one or both of the variable restrictions 232A and 232B may be operated to allow a finite increase in the difference in the displacements of the tilt cylinders 202A and 202B during the dump cycle. Further explanation pertaining to the operation of one or both variable restrictions 232A and 232B, will be made later in this document.

Moreover, although cylinder displacement is disclosed herein; it should be noted that in alternative embodiments of the current disclosure, cylinder velocity may be used in lieu of cylinder displacement as a basis for controlling movement of the tilt cylinders 202A, 202B and explanation pertaining to the use of cylinder velocity in lieu of cylinder displacement will be made later herein.

The control system 200 may also include a pair of tilt cylinder sensors 216A, 216B (also collectively referred to as "the tilt cylinder sensor/s 216") associated with each of the tilt cylinders 202A, 202B. The tilt cylinder sensors 216 may be configured to generate signals indicative of a displacement of the corresponding tilt cylinders 202. Specifically, the signals are indicative of the displacement of the rods 204A, 204B within the corresponding tilt cylinders 202A, 202B. A person of ordinary skill in the art will understand that operational velocities of each of the tilt cylinders 202 may also be determined using the respective displacements. In an example, the tilt cylinder sensors 216 may be position sensors. In other embodiments, the tilt cylinder sensors 216 may embody other type of sensors known in the art configured to determine the displacements and/or the operational velocities of the associated tilt cylinders 202.

As such, in an embodiment of this disclosure, the tilt cylinders 202A, 202B and/or the tilt valve unit 215 may be configured so as to be controlled based on a user input. Additionally or optionally, the tilt cylinders 202A, 202B and/or the tilt valve unit 215 may also be configured to be controlled automatically based on a type of the operation being performed, or a profile of the surface on which the operation is performed or other parameters that are to be met on a job site.

The control system 200 may include a pair of lift cylinders 220A, 220B (also collectively referred to as "the lift cylinders 220") operatively coupled to the work implement 110. Each of the lift cylinders 220A, 220B includes a first end 222A, 222B and a second end 224A, 224B respectively. In the illustrated embodiment, the first ends 222A, 222B are shown pivotally coupled to the work implement 110. Further, the second ends 224A, 224B are shown pivotally coupled to the frame 102 of the machine 100. In an example, the coupling of the first ends 222A, 222B, and the second ends 224A, 224B with the work implement 110 and the frame 102 respectively may be accomplished using fasteners such as clevis pin, pivot pins and the like. The lift cylinders 220A, 220B are configured to raise or lower the work implement 110 with respect to the frame 102 of the machine 100.

In the illustrated embodiment, the first ends 222A, 222B of the lift cylinders 220A, 220B are located proximal to the work implement 110, while the second ends 224A, 224B are located proximal frame 102. However, in alternate embodiments, the first ends 222A, 222B could be located proximal to the frame 102 while the second ends 224A, 224B could be located proximal to the work implement 110.

Referring to FIG. 3, the control system 200 may also include a lift valve unit 226 configured to regulate a supply of hydraulic fluid to and from each of the lift cylinders 220A, 220B. Similar to the tilt valve unit 215, the lift valve unit 226 may include a pair of first and second valve assemblies (not shown). As shown, the lift valve unit 226 may be in fluid communication with the fluid source 218 and the fluid tank 219. The fluid source 218 may be disposed in selective fluid communication with the rod ends 225A, 225B and the cap ends 227A, 227B of the corresponding lift cylinders 220A, 220B. As such, when the fluid source 218 is fluidly connected to the rod ends 225A, 225B generally, the fluid tank 219 can be fluidly connected to the cap ends 227A, 227B respectively. Conversely, when the fluid source 218 is fluidly connected to the cap ends 227A, 227B generally, the fluid tank 219 can be fluidly connected to the rod ends 225A, 225B respectively. In the illustrated embodiment, the length of the lift cylinders 220A, 220B may be changed via an extending or a retracting movement of the rods 229A, 229B inside the corresponding lift cylinders 202A, 202B. This extending or retracting movement of the rods 229A, 229B results from changing the relative volumes of hydraulic fluid in the rod ends 225A, 225B and the cap ends 227A, 227B. Further, the lift cylinders 220A, 220B may be configured such that, an extension or a retracting movement of the rods 229A, 229B may cause a raising or lowering movement to the work implement 110. In an example, the pressurized hydraulic fluid may flow into the rod ends 225A, 225B of the lift cylinders 220A, 220B and out of the cap ends 227A, 227B of the lift cylinders 220A, 220B thereby retracting rods 229A, 229B into the lift cylinders 220A, 220B and raising the work implement 110.

As is the case with the tilt cylinders 202A, 202B of the present disclosure, in one embodiment, the lift cylinders 220A, 220B and/or the lift valve unit 226 may also be configured to be controlled based on a user input. Additionally or optionally, the lift cylinders 220A, 220B and/or the lift valve unit 226 may also be configured to be controlled automatically based on a type of the operation being performed, or a profile of the surface on which the operation is performed or other requirements that are to be met on a job site.

Although, the tilt valve unit 215 and the lift valve unit 226 are shown to be in fluid communication with the same fluid source 218 and the fluid tank 219, it may be contemplated to implement a different fluid source and/or a different fluid tank for the tilt valve unit 215 and the lift valve unit 226.

The control system 200 further includes a controller 230. The controller 230 may be an electronic controller that operates in a logical fashion to perform operations, execute control algorithms, store and retrieve data and other desired operations. The controller 230 may include or access memory, secondary storage devices, processors, and any other components for running an application. The memory and secondary storage devices may be in the form of read-only memory (ROM) or random access memory (RAM) or integrated circuitry that is accessible by the controller 230. Various other circuits may be associated with the controller 230 such as power supply circuitry, signal conditioning circuitry, driver circuitry, and other types of circuitry.

The controller 230 may be a single controller or may include more than one controller disposed to control various functions and/or features of the machine 100. The term "controller" is meant to be used in its broadest sense to include one or more controllers and/or microprocessors that may be associated with the machine 100 and that may cooperate in controlling various functions and operations of the machine 100. The functionality of the controller 230 may be implemented in hardware and/or software without regard to the functionality employed. The controller 230 may also use one or more data maps relating to the operating conditions of the machine 100 that may be stored in the memory of the controller 230.

The controller 230 may be configured to determine an occurrence of the dump cycle for the work implement 110 based on any methods known in the art. In an example, the controller 230 may detect the dump cycle based on the commands from the operator provided via the input device in the cab 112. These commands may be transmitted via sensors and/or communication links to the controller 230. In another example, the controller 230 may detect the dump cycle based on a position of the tilt cylinders 202A, 202B and/or the lift cylinders 220A, 220B. Moreover, these methods of determining or detecting the dump cycle for the machine 100 are well known in the art and a detailed description is not included herein.

The controller 230 is communicably coupled to the regenerative valves 214A and 214B via a pair of solenoid switches 234A and 234B respectively. The controller 230 is configured to command one or both the solenoid switches 234A and 234B into varying an amount of restriction in the variable restrictions 232A, 232B of at least one of the regenerative valves 214A, 214B. This way, the controller 230 can actuate the regenerative valves 214A and 214B for variably regulating an amount of fluid flowing between the cap end 206A, 206B and the rod end 208A, 208B of the corresponding tilt cylinder 202A, 202B during the dump cycle of the work implement 110. Therefore, actuation of one or both regenerative valves 214A and 214B can help to control a movement of one or both tilt cylinders 202A, 202B, for e.g., when there is an uneven load distribution across the load-bearing surface of the work implement 110, or when one of the tilt cylinders 202A/202B is prone to overrunning with respect to another of the tilt cylinders 202A/202B.

The controller 230 may also be communicably coupled to a pair of tilt cylinder sensors 216A and 216B associated with the tilt cylinders 202A and 202B respectively. The controller 230 may receive signals indicative of displacements of each of the tilt cylinders 202A, 202B from the corresponding tilt cylinder sensors 216A, 216B. In one embodiment, the controller 230 may be configured to regulate the flow of fluid through the variable restrictions 232A and 232B of at least one of the regenerative valves 214A and 214B in order to at least reduce a difference between the displacements of the tilt cylinders 202A and 202B during the dump cycle. In another embodiment, the controller 230 may be configured to regulate the flow of fluid through the variable restrictions 232A and 232B of at least one of the regenerative valves 214A and 214B in order to maintain the difference between the displacements of the tilt cylinders 202A and 202B during the dump cycle. In yet another embodiment, the controller 230 may be configured to regulate the flow of fluid through the variable restrictions 232A and 232B of at least one of the regenerative valves 214A and 214B to reduce the difference between the tilt cylinders 202A and 202B to a predetermined value and further maintain the difference at the predetermined value. In yet another embodiment, the controller 230 may be configured to regulate the flow of fluid through the variable restrictions 232A and 232B of at least one of the regenerative valves 214A and 214B to allow a limited increase in the difference in the displacements of the tilt cylinders 202 during the dump cycle.

Additionally or optionally, the controller 230 may determine operational velocities of each of the tilt cylinders 202A and 202B based on the displacements related signals received via the tilt cylinder sensors 216A and 216B. Accordingly, the controller 230 may regulate the flow of fluid through the variable restrictions 232A and 232B of at least one of the regenerative valves 214A and 214B in order to equalize or limit the difference in the operational velocities and/or the displacements between the tilt cylinders 202A and 202B respectively.

During the dump cycle, the work implement 110 may be raised to a suitable height via the lift cylinders 220 and also tilted via the tilt cylinders 202 to perform the dumping operation. Moreover, to tilt the work implement 110 uniformly, the pressurized fluid may be supplied to the cap ends 206A, 206B and consequently the rods 204A, 204B are extended out of the corresponding tilt cylinders 202A, 202B. Further, each of the tilt cylinders 220 may operate accordingly to rotate the work implement 110 about the transverse axis BB' during the dump cycle. However, with implementation of the control system 200 disclosed herein, during the dump cycle, if one of the rods 202A, 202B is in a retracted position while the other of the rods 202A, 202B is in an extended position, the controller 230 can be configured to beneficially regulate the amount of flow through at least one of the regenerative valves 214A and 214B i.e., through the variable restrictions 232A, 232B present in at least one of the regenerative valves 214A and 214B in order to prevent any further extension of the corresponding rods 202A, 202B beyond the desired position and/or equalize the operational velocities or displacements of each of the tilt cylinders 202.

Accordingly, the controller 230 may identify an overrunning tilt cylinder 202 based on the displacements and/or the operational velocities. In one embodiment, the controller 230 may be configured to determine the overrunning tilt cylinder 202 as the tilt cylinder having a greater operational velocity or greater displacements among the pair of tilt cylinders 202A, 202B.

For example, the controller 230 may determine the overrunning tilt cylinder (for e.g., tilt cylinder 202A) as the tilt cylinder in the extending state during the dumping operation based on the displacements and/or the operational velocities. In such a case, the controller 230 may implement a closed state of the regenerative valve 214A. Moreover, the controller 230 may increase the magnitude of the variable restriction 232A to decrease the flow of fluid from fluid 212A into fluid line 210A. Further, the controller 230 may also decrease a supply of the pressurized hydraulic fluid from valve assembly 217A to the cap end 206A of the overrunning tilt cylinder 202A to reduce the rate of displacement i.e., rate of extension of the rod 204A out of the corresponding tilt cylinder 202A.

In one embodiment, the controller 230 may control the supply via the valve assemblies 217A and 217B of the tilt valve unit 215 in order to reduce the difference between the displacements of each of the tilt cylinders 202A, 202B. Additionally, the controller 230 may suitably modulate the variable restrictions 232A and 232B associated with at least one of the regenerative valves 214A and 214B to reduce the difference between the displacements of the tilt cylinders 202A and 202B respectively. Moreover, the controller 230 may regulate the supply until the operational velocities and/or displacements of each of the tilt cylinders 202A, 202B are substantially equal to each other. In another embodiment, the controller 230 may control the supply so as to maintain the difference between the displacements determined for the tilt cylinders 202A, 202B. Accordingly, the controller 230 may modulate the variable restrictions 232A and 232B associated with at least one of the regenerative valves 214A and 214B to maintain the difference.

Similarly, the controller 230 may be configured to regulate the supply of hydraulic fluid via the tilt valve unit 215 to any of the tilt cylinders 202A, 202B so as to maintain, reduce, equalize or limit the difference between the displacements and/or operational velocities of the tilt cylinders 202A, 202B.

In another embodiment, it may be noted that during a work implement 110 tilting event where the tilt cylinders 202A, 202B may be moved to different positions, the relative length of the lift cylinders 220A, 220B may also change. The difference in relative length of the lift cylinders 220A, 220B can be used to derive the difference in the relative displacements of the tilt cylinders 202A, 202B. Therefore, the controller 230 can use the relative difference in the displacements or velocities of lift cylinders 220A, 220B to determine the amount of desired restrictions 232A, 232B for executing control in the movement of the tilt cylinders 202A, 202B.

In various embodiments of the present disclosure, although systems and methods are disclosed in conjunction with the tilt cylinders 202A, 202B, it may be noted that such systems and methods can be equally applied to execute independent control of the lift cylinders 220A, 220B. Therefore, notwithstanding anything contained in this document, it may be noted that systems and methods disclosed herein should not be construed as being limited to tilt cylinders 202A, 202B alone. Rather a scope of implementation of the systems and methods of the present disclosure can extend to the lift cylinders 220A, 220B disclosed herein.

INDUSTRIAL APPLICABILITY

Figure 4:
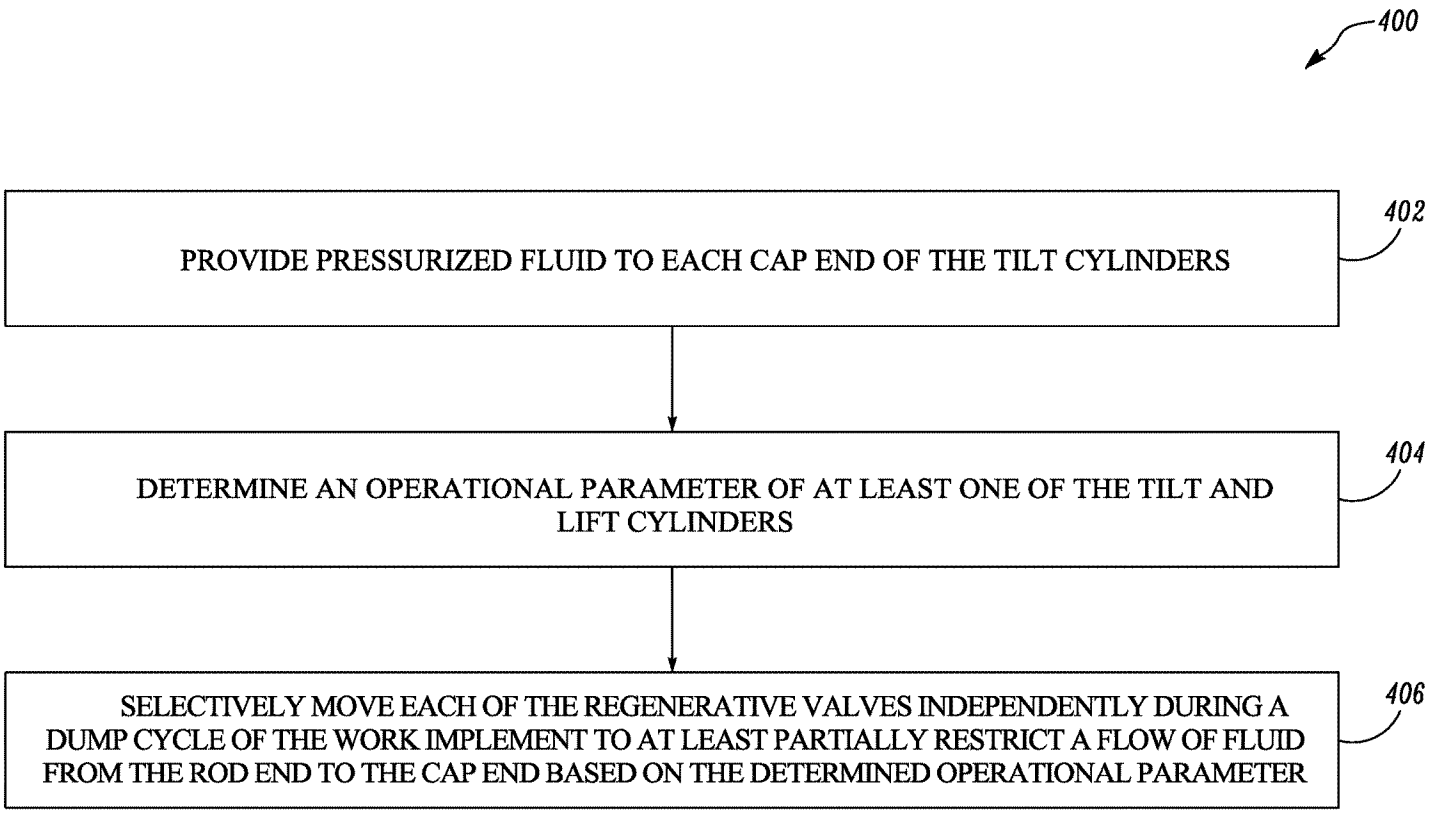
FIG. 4 is a flowchart of a method of controlling the work implement, according to an embodiment of the current disclosure.

Referring to FIG. 4, a method 400 of controlling a work implement of a machine having a pair of lift cylinders is illustrated. The method 400 disclosed herein will be explained in conjunction with the machine 100 of FIG. 1 and the control system 200 of FIG. 2. A reader of this document is hereby advised to refer to FIGS. 1 and 2 for a better understanding of this disclosure. However, it may be noted that the method 400 of the present disclosure is not limited to the machine 100 of FIG. 1 and the control system 200 of FIG. 2, rather, the method 400 of the present disclosure can be suitably implemented in any other type of machine to independently control a movement of cylinders present in the machine.

As disclosed earlier herein, the work implement 110 may be configured to perform digging operation to dig the material from the work site and move to a dump site while holding the material, and finally dumping the material at the dump site. In an embodiment, the dump cycle for the work implement 110 may be defined as a cycle in which the work implement 110 holds and dumps the material. Accordingly, during the dump cycle, the work implement 110 may be moved along the longitudinal axis AA' and/or raised to reach the dumping location and also rotated about the longitudinal axis AA' and/or the transverse axis BB' of the frame 102 for dumping the material.

The machine 100 includes the tilt cylinders 202A, 202B that are operatively coupled to the work implement 110 and are configured to tilt the work implement 110 with respect to the frame 102 of the machine. Further, as disclosed earlier herein, each of the tilt cylinders 202A, 202B includes the respective rod end 208A, 208B and the respective cap end 206A, 206B. The machine may also include the lift cylinders 220A, 220B that are configured to raise or lower the work implement 110 with respect to the frame 102 of the machine 100.

At step 402, the method 400 includes providing pressurized fluid to each cap end 206A, 206B of the tilt cylinders 202A, 202B. As disclosed herein, the fluid source can selectively communicate pressurized fluid with the cap ends 206A, 206B of each tilt cylinder 202A, 202B. At step 404, the method 400 further includes determining an operational parameter of at least one of the tilt and lift cylinders 202A, 202B and 220A, 220B. In one embodiment, the operational parameter could include cylinder displacement. In another embodiment, the operational parameter could include cylinder velocity that could be measured during movement of a given cylinder 202A, 202B and/or 220A, 220B.

At step 406, the method 400 further includes selectively moving each of the regenerative valves 214A, 214B independently during a dump cycle of the work implement 110 to at least partially restrict a flow of fluid from the rod end 208A, 208B to the cap end 206A, 208B based on the determined operational parameter.

If cylinder displacement is used as the operational parameter for independently controlling the work implement 110, the method 400 includes selectively moving each of the regenerative valves 214A, 214B during a dump cycle of the work implement 110 independently to at least partially restrict a flow of fluid from the rod end 208A, 208B to the cap end 206A, 208B based on a difference between the current displacements of the pair of tilt cylinders 202A, 202B during the dump cycle.

However, if cylinder velocity is used as the operational parameter for independently controlling the work implement 110, the method 400 includes selectively moving each of the regenerative valves 214A, 214B during a dump cycle of the work implement 110 independently to at least partially restrict a flow of fluid from the rod end 208A, 208B to the cap end 206A, 208B based on a difference between the current velocities of the pair of tilt cylinders 202A, 202B during the dump cycle.

As such, in one embodiment, the method 400 includes regulating at least one regenerative valve 214A, 214B to maintain the work implement 110 substantially parallel to the transverse axis BB' of the frame 102 of the machine 100. More specifically, the method 400 includes variably restricting a flow of fluid between one of the cap end 206A/206B and the rod end 208A/208B to the fluid line 210A, 210B or 212A, 212B associated with the other of the cap end 206A/206B and the rod end 208A/208B of the at least one tilt cylinder 202A/202B.

In various embodiments disclosed herein, the method 400 may also include determining the displacements of each cylinder 202, 220. In an example, the displacements of the tilt cylinders 202 may be determined via the tilt cylinder sensors 216. In one embodiment, the method 400 may include regulating a flow of hydraulic fluid to and from the pair of tilt cylinders 202 to at least reduce a difference between the displacements of the pair of the tilt cylinders 202 during the dump cycle. Moreover, the controller 230 may regulate the supply until the displacements of each of the tilt cylinders 202A, 202B are substantially equal to each other. In another embodiment, the method 400 may include regulating a flow of the hydraulic fluid to and from the pair of tilt cylinders 202 to maintain the difference between the displacements of the pair of the tilt cylinders 202 during the dump cycle. In yet another embodiment, the method 400 may include regulating a flow of the hydraulic fluid to and from the pair of tilt cylinders 202 to allow a limited increase in the difference.

In an embodiment, the flow of the hydraulic fluid to and from the pair of tilt cylinders 202A, 202B may be regulated via the tilt valve unit 215. In an example, the overrunning tilt cylinder 202 may be identified based on the displacements; and a return of the fluid from one of the cap ends 206A, 206B or the rod ends 208A, 208B to the other of the cap ends 206A, 206B or the rod ends 208A, 208B may be variably restricted by the variable restrictions 232A, 232B from at least one of the regenerative valves 214A, 214B.

With an implementation of the control system 200 and/or the method 400 in any machine, an undesirable tilt during the dump cycle may be reduced. Further, the controller 230 may also configured to regulate a flow of fluid to the tilt cylinders 202 during the dump cycle. As such, at least one of the operational velocity and/or displacement of the tilt cylinder 202 with a greater load among the pair of tilt cylinders 202 may be reduced to an optimum operational velocity and/or displacement. Moreover, such an implementation may also avoid overrunning of the tilt cylinders 202.

Further, the control system 200 of the present disclosure is configured to utilize tilt cylinder sensors 216 that may be commonly implemented in the existing machines. The tilt cylinder sensors 216 are configured to provide displacements of each of the tilt cylinders 202 to the controller 230. Since a tilt in the work implement 110 may cause a change to the relative displacements of the tilt cylinders 202, the tilt can thus be monitored through the tilt cylinder sensors 216. With implementation of the present control system 200 and/or the method 400, an overrunning tilt cylinder 202 may be identified. During the overrunning tilt cylinder event, the supply of the fluid to each tilt cylinder 202A, 202B may be accordingly regulated until the operational velocities of both tilt cylinders 202 are substantially equal.

Further, the control system 200 of the present disclosure may be configured to utilize lift cylinder sensors 221A, 221B in the same manner as described for the tilt cylinder sensors 216A, 216B that may be commonly implemented in existing machines. The lift cylinder sensors 221A, 221B are configured to provide displacements of each of the lift cylinders 220 to the controller 230. Since a tilt in the work implement 110 may cause a change to the relative displacements of the lift cylinders 220A, 220B, the tilt can thus be monitored through the lift cylinder sensors 221A, 221B. With implementation of the present control system 200 and/or the method 400, an overrunning tilt cylinder 202A, 202B may be identified. Upon detection of an overrunning tilt cylinder 202A, 202B, the supply of the fluid to each tilt cylinder 202A, 202B may be accordingly regulated until the operational velocities of both tilt cylinders 202 are substantially equal.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A control system for a work implement of a machine having a frame, the control system comprising:

a fluid source configured to provide a supply of pressurized fluid;

a pair of tilt cylinders in fluid communication with the fluid source, the tilt cylinders coupled to the work implement and configured to operably extend or retract to move the work implement with respect to the frame of the machine, each of the pair of tilt cylinders having a rod end and a cap end;

a valve assembly disposed between the fluid source and each tilt cylinder, each valve assembly configured to selectively regulate the supply of pressurized fluid to the rod end and the cap end of the corresponding tilt cylinder to extend and retract the tilt cylinder;

a regenerative valve disposed between each valve assembly and corresponding tilt cylinder, each regenerative valve configured with an open position where the regenerative valve fluidly connects the corresponding valve assembly to the rod end and the cap end of the corresponding tilt cylinder, and a closed position where the regenerative valve fluidly connects the corresponding valve assembly to the cap end of the corresponding tilt cylinder and fluidly connects the rod end to the cap end of the corresponding tilt cylinder, and wherein each regenerative valve includes a variable restriction to variably restrict or permit a flow of fluid between the rod end and the cap end of the corresponding tilt cylinder when the regenerative valve is in the closed position;

a tilt cylinder sensor associated with each tilt cylinder, each tilt cylinder sensor configured to generate tilt cylinder sensor signals indicative of a displacement of the corresponding tilt cylinder; and a controller communicably coupled to the each of the valve assemblies, each of the regenerative valves and each of the tilt cylinder sensors, in response to a dump cycle of the work implement, the controller is configured to vary an amount of restriction at the variable restriction in each regenerative valve to regulate an amount of fluid flowing between the rod end and the cap end of the corresponding tilt cylinder.

2. The control system of claim 1 further comprising:

a pair of lift cylinders in fluid communication with the fluid source; and a position sensor associated with each of the lift cylinders, each of the position sensors configured to generate signals indicative of a displacement and velocity of the corresponding cylinder.

3. The control system of claim 1, wherein the controller is communicably coupled to the regenerative valves and the position sensors, and wherein the controller is further configured to determine the displacement of each of the tilt cylinders, and when the displacements are not substantially the same, the controller is configured to regulate the flow of fluid through each regenerative valve to reduce a difference between the displacements of the pair of tilt cylinders during the dump cycle.

4. The control system of claim 1, wherein the controller is communicably coupled to the regenerative valves and the position sensors, and wherein the controller is further configured to determine the velocity of each of the tilt cylinders, and when the displacements are not substantially the same, the controller is configured to regulate the flow of fluid through each regenerative valve to reduce a difference between the velocities of the pair of tilt cylinders during the dump cycle.

5. The control system of claim 1, wherein the pair of tilt cylinders are operable to rotate the work implement about at least one of: a longitudinal axis and a transverse axis of the frame of the machine.

6. The control system of claim 5, wherein during the dump cycle of the work implement, the controller is configured to regulate the variable restriction of at least one of the regenerative valves to maintain the work implement substantially parallel to the transverse axis of the frame of the machine.

7. The control system of claim 1, wherein each of the regenerative valves is a spring-loaded spool valve.

8. A method of controlling a work implement of a machine having a pair of tilt cylinders and a pair of lift cylinders operatively coupled to the work implement and configured to move the work implement with respect to a frame of the machine, each tilt and lift cylinder having a rod end and a cap end, the rod end and the cap end of each tilt cylinder be fluidly coupled to a fluid source via a valve assembly and a regenerative valve disposed therein, each regenerative valve being movable between an open position where the regenerative valve fluidly connects the corresponding valve assembly to the rod and the cap end of the corresponding tilt cylinder and a closed position where the regenerative valve fluidly connects the corresponding valve assembly to the cap end of the corresponding tilt cylinder and fluidly connects the rod end to the cap end of the corresponding cylinder, and wherein each regenerative valve includes a variable restriction to variably restrict or permit a flow of fluid between the rod end and the cap end of the corresponding tilt cylinder when the regenerative valve is in the closed position, the method comprising:

providing pressurized fluid to each cap end of the tilt cylinders via the corresponding valve assembly and regenerative valve;

determining an operational parameter of at least one of the tilt and lift cylinders;

selectively moving each of the variable restrictions of the regenerative valves independently during a dump cycle of the work implement to at least partially restrict a flow of fluid from the rod end to the cap end of the corresponding tilt cylinder based on the determined operational parameter.

9. The method of claim 8, wherein the operational parameter is a cylinder displacement, wherein the step of selectively moving each of the variable restrictions of the regenerative valves comprises:

selectively moving each of the variable restrictions of the regenerative valves during a dump cycle of the work implement independently to at least partially restrict a flow of fluid from the rod end to the cap end of the corresponding tilt cylinder based on a difference between the current displacements of the pair of tilt cylinders during the dump cycle.

10. The method of claim 8, wherein the operational parameter is a cylinder velocity, wherein the step of selectively moving each of the variable restrictions of the regenerative valves comprises:

selectively moving each of the variable restrictions of the regenerative valves during a dump cycle of the work implement independently to at least partially restrict a flow of fluid from the rod end to the cap end of the corresponding tilt cylinder based on a difference between the current velocities of the pair of tilt cylinders during the dump cycle.

11. The method of claim 8 further comprising regulating at least one regenerative valve from the pair of regenerative valves to maintain the work implement substantially parallel to a transverse axis of the frame of the machine.

12. The method of claim 8, wherein each of the regenerative valves is a spring-loaded spool valve.

13. A machine comprising:

a frame;

a work implement movably coupled to the frame;

a fluid source disposed on the frame and configured to provide a supply of pressurized fluid;

a pair of tilt cylinders in fluid communication with the fluid source, the tilt cylinders coupled to the work implement and configured to operably extend or retract to move the work implement with respect to the frame of the machine, each of the pair of tilt cylinders having a rod end and a cap end;

a valve assembly disposed between the fluid source and each tilt cylinder, each valve assembly configured to selectively regulate the supply of pressurized fluid to the rod end and the cap end of the corresponding tilt cylinder to extend and retract the tilt cylinder;

a regenerative valve disposed between each valve assembly and corresponding tilt cylinder, each regenerative valve configured with an open position where the regenerative valve fluidly connects the corresponding valve assembly to the rod end and the cap end of the corresponding tilt cylinder, and a closed position where the regenerative valve fluidly connects the corresponding valve assembly to the cap end of the corresponding tilt cylinder and fluidly connects the rod end to the cap end of the corresponding tilt cylinder, and wherein each regenerative valve includes a variable restriction to variably restrict or permit a flow of fluid between the rod end and the cap end of the corresponding tilt cylinder when the regenerative valve is in the closed position;

a tilt cylinder sensor associated with each tilt cylinder, each tilt cylinder sensor configured to generate tilt cylinder sensor signals indicative of a displacement of the corresponding tilt cylinder; and a controller communicably coupled to the each of the valve assemblies, each of the regenerative valves and each of the tilt cylinder sensors, in response to a dump cycle of the work implement, the controller is configured to vary an amount of restriction at the variable restriction in each regenerative valve to regulate an amount of fluid flowing between the rod end and the cap end of the corresponding tilt cylinder.

14. The machine of claim 13 further comprising:

a pair of lift cylinders in fluid communication with the fluid source; and a position sensor associated with each of the lift cylinders, each of the position sensors configured to generate signals indicative of a displacement and velocity of the corresponding cylinder.

15. The machine of claim 13, wherein the controller is communicably coupled to the regenerative valves and the position sensors, and wherein the controller is further configured to determine the displacement of each of the tilt cylinders, and when the displacements are not substantially the same, the controller is configured to regulate the flow of fluid through each regenerative valve to reduce a difference between the displacements of the pair of tilt cylinders during the dump cycle.

16. The machine of claim 13, wherein the controller is communicably coupled to the regenerative valves and the position sensors, and wherein the controller is further configured to determine the velocity of each of the tilt cylinders, and when the displacements are not substantially the same, the controller is configured to regulate the flow of fluid through each regenerative valve to reduce a difference between the velocities of the pair of tilt cylinders during the dump cycle.

17. The machine of claim 13, wherein the controller is further configured to actuate at least a partially closed position in at least one regenerative valve to regulate an amount of fluid flowing between the fluid source and at least one of the tilt cylinders during the dump cycle of the work implement.

18. The machine of claim 13, wherein the pair of tilt cylinders are configured to operably rotate the work implement about at least one of: a longitudinal axis and a transverse axis of the frame of the machine.

19. The machine of claim 18, wherein during the dump cycle of the work implement, the controller is configured to regulate the variable restriction of at least one of the regenerative valves from the pair of regenerative valves to maintain the work implement substantially parallel to a transverse axis of the frame of the machine.

20. The machine of claim 13, wherein each of the regenerative valves is a spring-loaded spool valve.

* * * * *